US009668327B2

(12) United States Patent
Dobai et al.

(10) Patent No.: US 9,668,327 B2
(45) Date of Patent: May 30, 2017

(54) SYSTEM FOR REMOTELY CONTROLLING A CONTROLLABLE DEVICE

(71) Applicant: KONINKLIJKE PHILIPS N.V., Eindhoven (NL)

(72) Inventors: Iulia Dobai, Eindhoven (NL); Jan Hendrik Poesse, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/915,355

(22) PCT Filed: Aug. 28, 2014

(86) PCT No.: PCT/EP2014/068229
§ 371 (c)(1),
(2) Date: Feb. 29, 2016

(87) PCT Pub. No.: WO2015/032679
PCT Pub. Date: Mar. 12, 2015

(65) Prior Publication Data

US 2016/0212831 A1 Jul. 21, 2016

(30) Foreign Application Priority Data

Sep. 4, 2013 (EP) ..... 13182909

(51) Int. Cl.
*H05B 37/02* (2006.01)
*H05B 33/08* (2006.01)
*G07C 9/00* (2006.01)

(52) U.S. Cl.
CPC ..... *H05B 37/0272* (2013.01); *G07C 9/00007* (2013.01); *H05B 33/0845* (2013.01); *H05B 33/0857* (2013.01); *H05B 37/0281* (2013.01)

(58) Field of Classification Search
None
See application file for complete search history.

(56) References Cited

U.S. PATENT DOCUMENTS 6,528,954 B1 3/2003 Lys
8,922,333 B1 * 12/2014 Kirkjan ..... 235/376
(Continued)

FOREIGN PATENT DOCUMENTS

WO WO2012166369 A2 12/2012
WO WO2013067569 A1 5/2013
WO WO2013085600 A2 6/2013

OTHER PUBLICATIONS

Suter G. et al, "Design of a personalized Lighting Control System Enabled by a Space Model" Department of Digital Architecture and Planning, Proceedings of the Eleventh Int'l Conference Enhanced Building Operations, New York, Oct. 18-20, 2011.

*Primary Examiner* — Vibol Tan
(74) *Attorney, Agent, or Firm* — Larry Liberchuk

(57) ABSTRACT

A system (100, 102) for remotely controlling a controllable device (110), the controllable device comprising a receiver (112) configured to receive a digital command, the controllable device being configured to modify an aspect of the controllable device in response to receiving the digital command, a mobile controller (120), the mobile controller comprising a tag reader (122) configured to connect directly to an electronic tag over a first wireless channel (152) and to receive information from the tag identifying the controllable device (110), and a sender (124) configured to wirelessly send the digital command to the controllable device over a second wireless channel (154) using the information identifying the controllable device, and an access control module (130) configured to selectively allow or block the mobile controller to control the controllable device through the digital command, the access control module being configured to allow the mobile controller to control the controllable device within a control period, the control period starting upon the tag reader wirelessly connecting to the (Continued)

electronic tag and terminating when a control release condition is satisfied.

13 Claims, 7 Drawing Sheets

(56) References Cited

U.S. PATENT DOCUMENTS

| | | | | |
|---|---|---|---|---|
| 8,929,861 | B2 * | 1/2015 | Carbonell Duque | 380/247 |
| 9,269,207 | B2 * | 2/2016 | Fyke | G07C 9/00015 |
| 2007/0014199 | A1 | 1/2007 | Park | |
| 2011/0199004 | A1 | 8/2011 | Henig | |
| 2011/0266345 | A1 | 11/2011 | Fowler | |
| 2012/0303827 | A1 | 11/2012 | Neystadt | |
| 2013/0221094 | A1 * | 8/2013 | Smith | G07C 9/00309 235/382 |
| 2014/0141721 | A1 * | 5/2014 | Kim | H04M 1/7253 455/41.2 |
| 2014/0219453 | A1 * | 8/2014 | Neafsey | H04B 5/0056 380/270 |
| 2014/0375421 | A1 * | 12/2014 | Morrison | G07C 9/00571 340/5.61 |
| 2015/0342011 | A1 * | 11/2015 | Brochu | H05B 37/0272 315/294 |

* cited by examiner

SYSTEM FOR REMOTELY CONTROLLING A CONTROLLABLE DEVICE

FIELD OF THE INVENTION

The invention relates to a system for remotely controlling a controllable device, the controllable device comprising a receiver configured to receive a digital command, the controllable device being configured to modify an aspect of the controllable device in response to receiving the digital command.

BACKGROUND OF THE INVENTION

Systems have previously been proposed for remotely controlling a controllable device. For example, U.S. Pat. No. 6,528,954, titled "Smart light bulb", included herein for reference, proposes a smart light bulb that includes in its housing an illumination source and a processor for controlling the illumination source. The smart light bulb also comprises a receiver coupled to the processor for receiving a data signal from an external device.

The smart light bulb can thus respond to a signal from another device and cause the processor to control, e.g., the intensity or the color of the illumination source. For example, the smart light bulb may be part of an entertainment system, in which the receiver receives a control signal to control the illumination source.

A drawback of such known systems, including the smart light bulb, is that they are not well suited for control by individual users.

SUMMARY OF THE INVENTION

It would be advantageous to have an improved system for remotely controlling a controllable device, in which individual users are capable of controlling the controllable device. Moreover, it would be advantageous to provide a system in which multiple users can control the controllable device.

A system for remotely controlling a controllable device is provided. The controllable device comprises a receiver configured to receive a digital command. The controllable device is configured to modify an aspect of the controllable device in response to receiving the digital command.

The system comprises a mobile controller and an access control module. The mobile controller comprises a tag reader configured to connect directly to an electronic tag over a first wireless channel and to receive information from the tag identifying the controllable device, and a sender configured to wirelessly send the digital command to the controllable device over a second wireless channel using the information identifying the controllable device.

The access control module is configured to selectively allow or block the mobile controller to control the controllable device through the digital command, the access control module being configured to allow the mobile controller to control the controllable device within a control period, the control period starting upon the tag reader wirelessly connecting to the electronic tag and terminating when a control release condition is satisfied.

A user can use his mobile controller to control the controllable device. However, he can only do so, i.e., the mobile controller is only enabled to control the controllable device, when a control period has started. To get a control period to start, the mobile controller needs to make a wireless connection to the electronic tag. In this way it is established that the mobile controller is, at least at that point in time, near to the electronic tag. Access conflicts are thus resolved naturally; users who are able to control the same device are likely to meet each other at or around the electronic tag. Indeed, the control period ends when a control release condition is satisfied. Moreover, when a resource can be controlled from a mobile controller, say a smartphone, by a user, it is often not desired that users that are not in the close proximity of the resource can issue control commands for it.

The system thus provides an asymmetrical method of gaining and releasing control. A mobile controller gains control through a narrow gate, i.e. the electronic tag, and releases control based on a less stringent condition, i.e., the control release condition. Preferably, the access control module is configured to, after the control period terminated, not to start a new control period until the tag reader wirelessly connects to the electronic tag again.

A wide variety of devices are suitable for use as a controllable device: Examples include luminaires, and HVAC (Heating Ventilation Air Conditioning) devices. The system may also be used for home automation devices such as remotely controllable blinds.

The control release condition could depend on a number of parameters, including properties associated with the user, e.g., his so-called 'role' in an access control system, the time of day, and the like. Two conditions have proven particularly advantageous, in particularly for situations where multiple users may want to control device: those based on location of the mobile controller and duration of the control period.

For example, the control release condition may define a geographic area, the access control module being configured to obtain location information indicating the geographic location of the mobile controller and to terminate the control period if the geographic location of the mobile controller is outside the geographic area.

For example, the control release condition may define a time period, the access control module being configured to terminate the control period after the control period lasted for at least the time period.

Combinations of location and duration are possible, e.g., by combining the condition with the 'and' or the 'or' operator. Further variations are possible. For example, the system may require a partially satisfied condition (like 60% of duration and/or 80% of geographic coverage; alternatively, the location and duration could be pre-scaled. A correction factor for a special condition could be added, e.g. 33% of time and duration in case of an emergency or specific incident.

By choosing the conditions small, i.e., a small area and/or a short duration, it can be enforced that access conflicts correspond with 'physical' conflicts. That is, two users who both have control are likely to be close to each other they can thus directly communicate and work out the access conflict. Through these technical means, the natural access control of a wall switch is extended to remote control by a mobile controller. What small is depends on the building and the normal use of the space, such as a room. For example, one could define the geographic area as a sphere with as centre, say the location of the controllable device or the electronic tag, and a radius. The radius could be smaller than 4 meters, 2 meters, 1 meter, or 50 cm. For example, one could define the time duration as smaller than 4 minutes, 2 minutes, 1 minute, or 30 seconds. The area could be an ellipsoid, e.g., defined by a major and minor radius R1 and R2.

On the other hand by choosing the conditions larger, it may be arranged that a person remains in control as long as he is likely to need it, but releases it when he likely does not need it. For example, the radius could be such that the mobile controller needs to leave the building to release control, or larger than 20 meters, 40 meters or 100 meters. For example, the duration could be larger than 2 hours, 4 hours or 8 hours. In this way, say, an office worker may leave his workplace temporarily, say for a lunch break, and still have control when he gets back. Nevertheless, control is released, say, during the night.

Other combinations of area and duration may be chosen as well.

The mobile controller may be a smart phone. The electronic tag may be an NFC tag, RFID tag or electronic label or proximity tag, like Bluetooth Smart tag.

In an embodiment, the electronic tag is configured for communicating with a configuration server, say a building management system, over a third channel. The electronic tag comprises a wired interface for connecting with the third channel. The configuration server is configured to store the identifying information and/or the control release condition in the electronic tag. In an embodiment, the access control module is comprised in the mobile controller, the access control module being configured to receive the control release condition from the electronic tag through the electronic tag reader.

The first wireless channel is direct and short-range connection between a mobile controller, such as mobile phone, and a tag. The first wireless channel may be NFC or possibly Bluetooth. The second wireless channel has a longer range than the first wireless channel. The second wireless channel connects the mobile controller and the controllable device. The second wireless channel need not be direct, and need not be completely wireless. At least the second channel is wireless starting at the mobile controller. Typically, the second wireless channel connects the mobile controller to a digital communications network connecting the mobile controller with the controllable device and possibly with the access control module. The third channel is between the electronic tag and another server. The third channel is different from the first channel. The third channel is typically wired, at least at the end where it connects to the tag.

In an embodiment, the range of the first communication channel is smaller than 50 centimeters; for example, the electronic tag may be an RFID or NFC tag. A first communication channel having a short range, e.g. smaller than 50 centimeters may also be implemented with other means for example, a Bluetooth proximity tag programmed to respond only at a pre-defined short distance, such as 50 cm or less.

The second wireless channel may comprise a so-called Wireless Local Area Networks (WLAN), e.g. as described in 'IEEE 802.11'. The second wireless channel may also comprise a so-called wireless personal area network (WPAN) such as IrDA, Wireless USB, or Bluetooth. The second wireless channel may also comprise a so-called Mesh network, e.g., Z-Wave, and ZigBee; e.g. as described in 'IEEE 802.15.4' or 'IEEE 802.15.4g'.

The mobile controller may be a mobile phone, or a tablet, or a laptop, etc. An aspect of the invention concerns a system for remotely controlling a controllable device further comprising the controllable device and the electronic tag. An aspect of the invention concerns the mobile controller, the electronic tag and the access module used in said system.

An aspect of the invention concerns a method for remotely controlling a controllable device.

An aspect of the invention concerns a computer program, for remotely controlling a controllable device.

A method according to the invention may be implemented on a computer as a computer implemented method, or in dedicated hardware, or in a combination of both. Executable code for a method according to the invention may be stored on a computer program product. Examples of computer program products include memory devices, optical storage devices, integrated circuits, servers, online software, etc. Preferably, the computer program product comprises non-transitory program code means stored on a computer readable medium for performing a method according to the invention when said program product is executed on a computer In a preferred embodiment, the computer program comprises computer program code means adapted to perform all the steps of a method according to the invention when the computer program is run on a computer. Preferably, the computer program is embodied on a computer readable medium.

BRIEF DESCRIPTION OF THE DRAWINGS

These and other aspects of the invention are apparent from and will be elucidated with reference to the embodiments described hereinafter. In the drawings.

Figure 1:
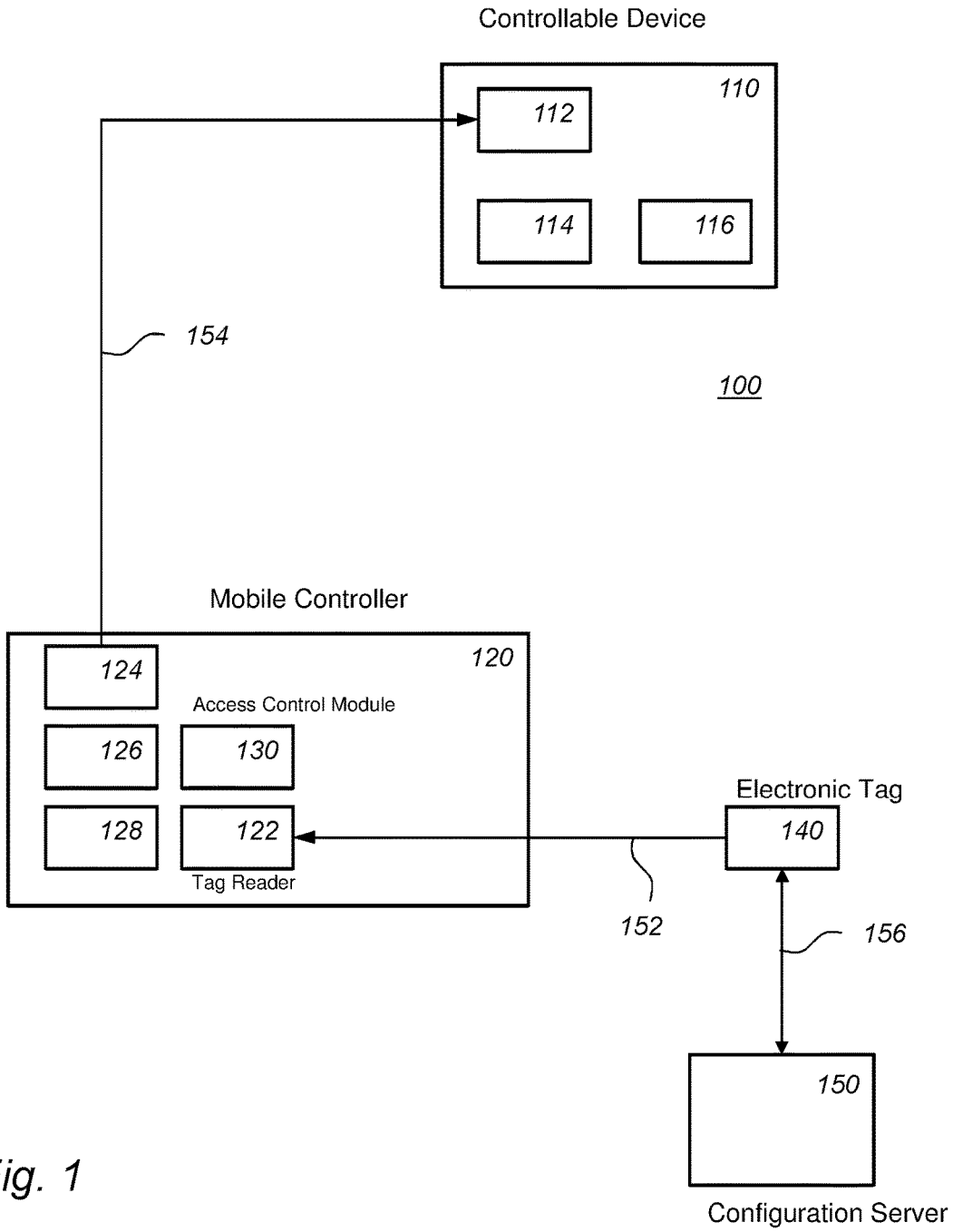
FIG. 1 is a block diagram illustrating a system for remotely controlling a controllable device.

It should be noted that items which have the same reference numbers in different FIGS., have the same structural features and the same functions, or are the same signals. Where the function and/or structure of such an item has been explained, there is no necessity for repeated explanation thereof in the detailed description.

LIST OF REFERENCE NUMERALS IN FIGS. 1-6*b*

100 a system for remotely controlling
102 a system for remotely controlling
110 a controllable device
112 a receiver configured to receive a digital command
114 command processor
116 device parameter storage
120 a mobile controller
122 a tag reader
124 a sender
126 a locator
128 a user interface controller
130 an access control module
132 a storage
134 a processor
136 a transceiver
140 an electronic tag
140*a* an electronic tag
140*b* an electronic tag
142 a public information storage

144 a private information storage
146 a processor
150 a configuration server
152 a first wireless channel
154 a second wireless channel
156 a third channel
200 a building
210 a floor
220 a first room
222 a first tag
224 a first luminaire
230 a second room
232 a second tag
234 a second luminaire
240 a third room
312 Authorized software information
314 Controllable device Identifier
316 Control release information
400 a mobile controller
410 slider user interface element

DETAILED EMBODIMENTS

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described.

FIG. 1 illustrates a system 100 for remotely controlling a controllable device 110.

System 100 comprises a controllable device 110, mobile controller 120, and an electronic tag 140.

Controllable device 110 comprises a receiver 112 configured to receive a digital command. Controllable device 110 is configured to modify an aspect of the controllable device in response to receiving the digital command. The controllable device shown in FIG. 1 comprises a command processor 114 and a device parameter storage 116. Processor 114 is configured to interpret the received command and to change one or more device parameters stored in parameter store 116. The device parameters influence or determine an aspect of the device. The system for remote controlling described herein is suited for home and office automation. The controllable devices may be home or office environment devices. The system for remote controlling described herein is also suited for hospitals, public buildings automation, and the like. A number of examples are given below. For example, controllable device 110 may be a luminaire. An aspect of the light that is emitted by the luminaire is remotely controlled. For example, system 100 may remotely control one or more of: dim level, light intensity, color, white level, and on/off state, of the luminaire. For example, parameter store 116 may comprise a parameter representing, say, light intensity. Controllable device 110 is configured to set its light intensity according to the light intensity parameter stored in parameter store 116. If a command is received at receiver 112, then processor 114 may determine that it requests to, say, increase the light intensity. Processor 114 then increases the light intensity parameter stored in parameter store 116, assuming it is not yet at a maximum. Controllable device 110 then changes its light to a higher intensity. Store 116 may be a memory.

Other examples of controllable device 110 include the following: the controllable device 110 may be a heating device. The aspect that is remotely controlled may be one of: heating intensity, ambient temperature, and the like. Controllable device 110 may be a ventilation device, wherein the aspect is ventilating intensity. Controllable device 110 may be an air-conditioning device, wherein the aspect is one of: air-conditioning intensity, ambient temperature, and the like. Controllable device 110 may be a remotely controllable blind, wherein the aspect is an open/close state of the blind, and the like.

The digital command may be encoded in a digital format, say ASN.1 or XML, and the like. Receiver 112 may be a wireless receiver, say a Wi-Fi receiver. Receiver 112 may be a wired receiver, say a receiver for an Ethernet cable. Receiver 112 may be a wireless receiver, part of a mesh network like with a Zigbee receiver, an IEEE 802.15.4 receiver, or an IEEE 802.15.4g receiver, etc.

Electronic tag 140 is associated with controllable device 110. The electronic tag is configured for direct wireless electronic communication over a first wireless channel 152 with a tag reader 122 of mobile controller 120. For example the electronic tag 140 may be an RFID, an NFC tag, or a proximity tag, such as a Bluetooth Smart. Typically, first wireless channel 152 will be an NFC connection. The range within which a connection can be made between mobile controller 120 and electronic tag 140 is so small that is proves that mobile controller 120 is in the vicinity of tag 140. Preferably, the range is chosen such that, the mobile controller 120 and electronic tag 140 must be in the same room in order to make contact. In embodiments, the range of first wireless channel 152 was chosen to be smaller than 50 centimeters. In some embodiments, the range of first wireless channel 152 is less than 10 cm, almost forcing mobile controller 120 to touch electronic tag 140. In some embodiment, electronic tag 140 and mobile controller 120 may be configured to require them to touch before a connection is established. More alternatively the link between the mobile controller and the tag could be made by the user Body Coupled Communication (BCC), BCC can establish a wireless connection between the mobile controller and the tag using the user's body.

Figure 3:
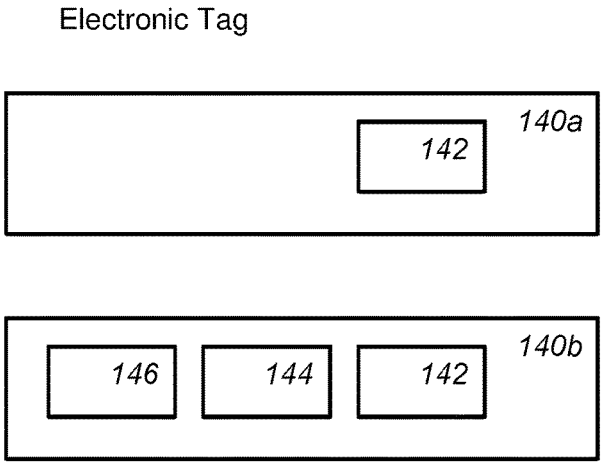
FIG. 3 is a block diagram illustrating two electronic tags.

Two tags that may be used in systems 100 and 102 for tag 140 are shown in FIG. 3. Tag 140*a* comprises a public information storage 142, also simply referred to as the storage. Storage 142 may be read out by a tag reader, in particular tag reader 122 of mobile controller 120. FIG. 3 also shows a more advanced tag 140*b*. In addition to public information storage 142, tag 140*b* also comprises a private information storage 144. Private information storage 144 is not readable for unprivileged users; private storage 144 may not be readable at all outside of the tag. For example, private storage 144 may only be accessible outside the tag through an alternative interface, e.g., a so-called dual interface, not through NFC. Private storage 144 may only be writable. Electronic tag 140*b* also comprises a processor 146 that can access private storage 144. Electronic tag 140*b* is suitable for more advanced communication options, such as challenge-response protocols. These options are more fully explained below.

Tag 140*b* is suited for a dual-interface; for example, tag 140*b* may be configured so that private storage 144 is only accessible through the alternative, wired, interface, yet public storage 142 is accessible, at least read accessible, through the wireless interface.

Tag 140, e.g. tags 140*a* and 140*b* may be a dual interface tag, which is only read-accessible through the wireless interface but read and write accessible through the wired interface. The wired interface is used to configure the tag, e.g., by a configuration server.

The words public and private indicate a different access control. A mobile controller configured for controlling the controllable device 110 is also configured to read-out the public storage. The private storage should be secret from ordinary users, and only be accessible to trusted users, if at all.

Typically, tag 140 and storage 142 are configured so that any tag reader can read out its contents. However, even then some access control may be employed. For example, the contents of storage 142 may be encrypted by a key. Mobile controller 120 receives the key from a different source, say out-of-band, from the access module, from a Building Management System (BMS), etc.

Storage 142 stores information identifying controllable device 120. That information may be used by mobile controller 120 to establish a second wireless connection 154 between mobile controller 120 and controllable device 110. There are different options for the identifying information. For example, the identifying information may comprise an identifier of controllable device 110. Controllable device 110 also comprises the same identifier. In that case, the command may be broadcasted to multiple controllable devices. The controllable devices are configured to execute on the command if they have the same identifier and to ignore it otherwise.

Compared with, say, a passive tag, a dual interface tags has 2 interfaces: the RF interface and another interface, e.g., an Inter-Integrated Circuit interface (I2C). The concept of public/private memory is different but related. Both an RF and a dual-interface tag could have public and private memory, it is however easier to implement on a dual interface. For example, a dual interface tag could have a piece of memory that is inaccessible through the RF interface. The latter is not needed, the system could use a dual interface tag in which all its memory is readable through RF.

The identifying information may be an electronic address, such as an IP address, of controllable device 110, or a unique identifier, for example a specific number, or a MAC address. The identifying information may also contain network credentials needed to establish a connection to controllable device 110, e.g., a password, e.g., a password to access a wireless network that controllable device 110 is connected to. The identifying information may also contain the SSID of a wireless network connected to controllable device 110.

Mobile controller 120 uses the information identifying controllable device 110 to send a command in an electronic message to device 110. The electronic message may contain control information based on the identifying information, thus configuring the message to reach controllable device 110. For example, device 120 may include the identifying information in the electronic message together with the command.

For example, the identifying information stored at electronic tag 140 may comprise a resource identifier, such as an identifier of a luminaire to control, also known as a "luminaire id".

Electronic tag 140 may be associated with multiple controllable devices. In this case electronic tag 140 comprises identifying information for multiple devices. The description below, assumes that only a single controllable device is associated with electronic tag 140, but it may be easily adapted to multiple controllable devices: For example, if any information specific to a particular controllable device is stored on electronic tag 140, then electronic tag 140 may also store the corresponding information for other devices. For example, the controller devices may be configured to listen for the identifier information from the tag and all controller devices that have a matching identifier will respond. In operation, the multiple controllable devices and the one associated tag will usually all be arranged in the same room.

Using a single electronic tag with multiple devices is suited for a room with multiple controllable devices, e.g. multiple lights, or a light and a HVAC device, etc. HVAC stands for Heating Ventilation and Air Conditioning.

Storage 142 may store information regarding the computer program code needed by mobile controller 120 to remotely control controllable device 110. For example, storage 142 may store computer program code itself; for example, as a so-called 'app' suitable for execution on smartphone 120. Storage 142 may also store information on where to get the software; for example, storage 142 may store the name of the app, or an URI or URL to the software. In particular, mobile controller 120 may be configured to receive from electronic tag 140 computer program code implementing the access control module.

Storage 142 may store the control release condition from the electronic tag through the electronic tag reader. This means that the access control policy is obtained from tag 140 rather than from a central management system. In FIG. 1, mobile controller 120 enforces the access control policy that it received from the tag.

Electronic tag 140 may be a so-called dual interface tag. A dual-interface tag is configured both with a wireless and a wired interface. This means that the tag is configured for first wireless channel 152 but can itself be configured through, say, a building management system using a third channel. For example, electronic tag 140 may be configured with a conventional NFC contactless interface, and a wired interface, such as the PC interface.

Electronic tag 140 may also have only a wireless interface. Electronic tag 140 may be configured through that interface. However, electronic tag 140 may also be manufactured together with controllable device 110, tag 140 and controllable device 110 each storing the same identifier; Tag 140 and controllable device 110 together forming a kit suitable for being sold together say.

Mobile controller 120 comprises a tag reader 122, a sender 124, and a user interface controller 128. Optionally, mobile controller 120 comprises one or both of a clock and a locator. Mobile controller 120 shown in FIG. 1 comprises both, shown is only locator 126.

Tag reader 122 is configured to connect directly to an electronic tag over a first wireless channel and to receive information from the tag identifying the controllable device. Tag reader 122 may be an NFC reader device. For example, tag reader 122 may read out storage 142 from electronic tag 140. If tag 140*b* is used, then mobile controller 120 does not have access to private storage 144.

Sender 124 is configured to wirelessly send the digital command to the controllable device over a second wireless channel 154 using the information identifying the controllable device. Sender 124 may use modulated radio frequencies to send an electronic message. For example, sender 124 may be a Wi-Fi sending device, or a mesh network such as Zigbee, 802.15.4, 802.15.g. Tag reader 122 may also be configured to access a wireless internet service, e.g. through a 3G or 4G service.

First wireless channel 152 is a direct wireless connection, i.e., there is no intermediate device between mobile controller 120 and electronic tag 140. However, second wireless channel 154, may, but need not be a direct connection.

Second wireless channel 154 may be a direct wireless connection to controllable device 110, but may also be wireless, up to an intermediate device, e.g. via a mesh network connected to multiple wireless connections, and wired from the intermediate device to controllable device 110, etc. The intermediate device may be module 130 (it is external) and/or a BMS.

Mobile controller 120 comprises a user interface controller 128. User interface controller 128 provides one or more of the controlling options of controllable device 110 to the user on a display of mobile controller 120 (not shown in FIG. 1). User interface controller 128 receives input from the user regarding the controlling option. For example, a user may express that some aspect of controllable device 110 may be increased or decreased.

Figure 6A:
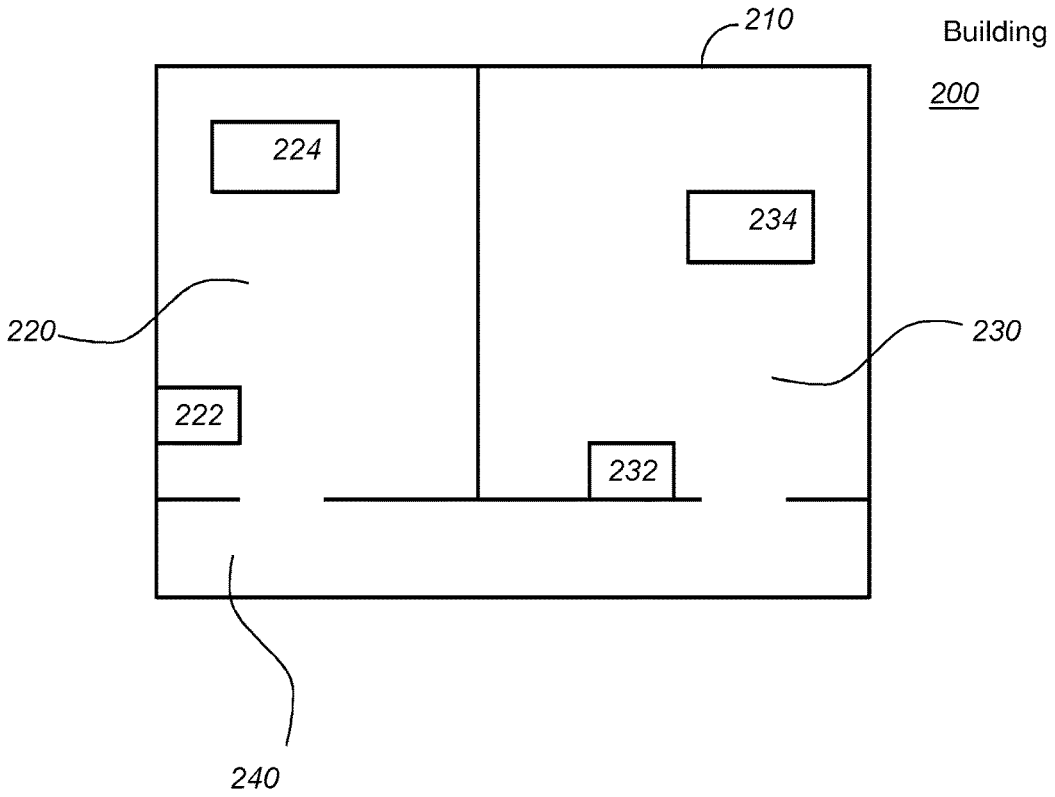
FIG. 6*a* is a schematic illustration of a system for remotely controlling controllable devices.
Figure 6B:
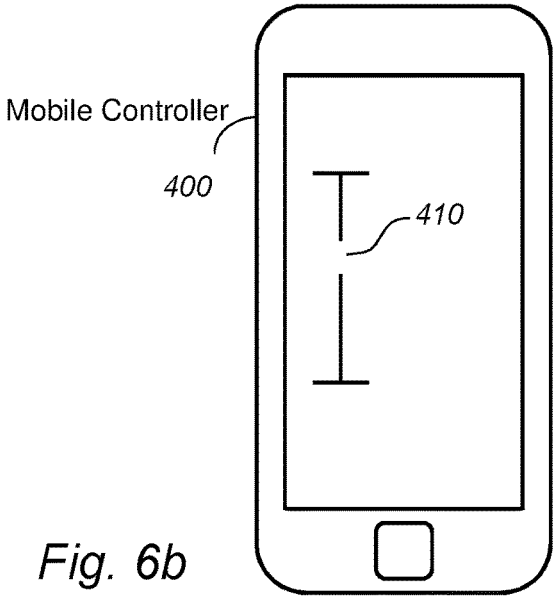
FIG. 6*b* is a schematic illustration of mobile controller.

FIG. 6*b* shows an example of a mobile controller 120, in the form of smartphone 400. A display of mobile controller 400 shows a slider 410. Slider 410 may be used by the user to control the aspect. For example, through slider 410 a user may inform user interface controller 128 that he wants the light intensity to increase or decrease, e.g., by sliding the slider up or down respectively. The display of mobile controller 400 is touch-sensitive.

User interface controller 128 may be configured to directly generate a digital command that may be executed by controllable device 110; however, this task may also be done by another unit of mobile controller 120, say access control module 130.

Mobile controller 120 may comprise a locator 126. Locator 126 is configured to determine the current location of mobile controller 120, i.e., to generate location information indicating the geographic location of mobile controller 120. Locator 126 may be configured to determine the current location of mobile controller 120 using a GPS signal, e.g. by comprising a GPS device; or using a Wi-Fi signal, e.g., from Wi-Fi access points having a known location; or using a Bluetooth signal, e.g. from Bluetooth beacons, or using a GSM signal; or another in-door location system. For example, using a Bluetooth signal, e.g. from Bluetooth beacons from known locations works similarly to using Wi-Fi signals from known locations.

The location system used need not necessarily be very accurate. Usually it is sufficient to determine the location up to a resolution of room-sizes. For some applications, it may even be sufficient to determine whether mobile controller 120 is in the building or not.

Mobile controller 120 may be configured to receive via tag reader 122 from electronic tag 140 computer program code implementing at least access control module 130. Possibly the computer program code also comprises other parts of mobile controller 120, such as user interface controller 128. Mobile controller 120 may also receive a location and/or identifier of the software, say a name. Mobile controller 120 may obtain the software either from electronic tag 140 directly or from another server, say using second wireless channel 154 and/or using the Internet. Mobile controller 120 is configured to install and run the software on mobile controller 120.

Mobile controller 120 comprises an access control module 130. Access control module 130 is configured to selectively allow or block mobile controller 120 to control controllable device 110 through digital commands. Access control module 130 is configured to allow mobile controller 120 to control controllable device 110 within a control period. The control period starts when tag reader 122 wirelessly connects to electronic tag 140 and terminates when a control release condition is satisfied. Access control module 130 is configured to verify that the control period of the mobile communication device has started and did not yet terminate before allowing mobile controller 120 to control controllable device 110.

There are a number of options for the location of access control module 130. The inventors found that a system for remotely controlling a controllable device may be distributed over different devices in various ways. In the embodiment shown in FIG. 1, access control module 130 is part of mobile controller 120. This is not necessary however; Access control module 130 could also be part of controllable device 110 or a separate device.

Controlling controllable device 110 may be done via controlling of a Building Management System (BMS). The BMS is connected to controllable device 110 and can control it. The BMS receives command from mobile controller 120 or access control module 130 and executes them. For example, the BMS may increase a luminaire's light intensity in response to receiving a command thereto from mobile controller 120 or access control module 130. Another possibility is that the smartphone requires certification from a BMS, before controllable device 110 will accept its commands. For example, mobile controller 120 may receive a digital certificate, e.g., a X.509 certificate from the BMS and uses it to digitally sign the digital command. Controllable device 110 can verify the signature and will refuse the command if the signature verification fails.

Also selectively allowing or blocking of control may be done in multiple ways: by blocking execution of the command at controllable device 110, by refusing to send or forward the digital command so that it never reaches controllable device 110 or by disabling part of the user interface offered by user interface controller 128 so that the user cannot formulate the command. If high security is needed some or all of these options may be used together.

Systems in which access control module 130 is part of mobile controller 120 are generally somewhat easier to make: No building management system is needed in which access control module 130 could be incorporated. Also controllable device 110 may be kept simpler, and thus cheaper, since it does not need to run access control module 130. However, having access control module 130 inside mobile controller 120 is also considered less secure.

Security may be addressed in various ways. For example, one may add additional access control to the system, e.g., requiring the digital command to be authenticated, e.g., by a private key of mobile controller 120 so that only authorized users can send valid commands. One may alternatively accept lower security requirements and rely on social control or legislative deterrents.

The system requires mobile controller 120 to be close to electronic tag 140, e.g., within 50 cm or even 10 cm, or even touching electronic tag 140 to make the first wireless channel. At that point mobile controller 120 can start controlling controllable device 110. Control will be maintained for a while but the system has a built in release of control. The control release condition may be defined depending on various parameters depending on the effect to be achieved. Two particular parameters have proven to be very effective, i.e., the location of mobile controller 120 and the time that elapsed since mobile controller 120 contacted electronic tag 140.

For example, the control release condition may define a geographic area. The access control module is configured to obtain location information indicating the geographic location of the mobile controller and to terminate the control period if the geographic location of the mobile controller is outside the geographic area. For example, the geographic area may be chosen to be close to the tag. For example, the geographic area may be within 100 cm of electronic tag 140, or within range of electronic tag 140. The later choice avoids the need of a locator, such as locator 126. Using location mimics the operation of a conventional wall switch. To control, say, a conventional light, one needs to physically go to the wall switch that controls that light. This control release condition gives a similar effect, as long as a user is physically close to electronic tag 140 he can control controllable device 110. This control release condition also naturally solves access conflict. If two users try to control the light at (around) the same time, they are physically next to each other. This immediately allows them to resolve the access conflict in a social setting rather than through a technical solution.

The geographic area may also be set larger, say to the size of a room. This is well suited for meeting rooms. As long as user stays in the meeting, he can control controllable device 110. However, once he leaves the meeting room he also surrenders control of controllable device 110.

The geographic area may also be set still larger, say to the size of the building. This is well suited for personal rooms. As long as user stays in the building, he can control controllable device 110. However, once he leaves the building he also surrenders control of controllable device 110. This avoids that a user can control, say, office lights from his home, but avoids releasing control whenever the user leaves his office.

Another possibility is for the control release condition to define a time period. Access control module 130 is configured to terminate the control period after the control period lasted for at least the time period. For example, access control module 130 may start a timer configured to give an interrupt when the time period has elapsed. When the interrupt is received access control module 130 terminates the control period. Access control module 130 may start the timer when mobile controller 120 contacts electronic tag 140 or when contact is broken. The latter option avoids release of control while the user is standing in front of electronic tag 140, which may be counterintuitive. On the other hand, when electronic tag 140 is integrated in a working area such as a desk, it may be better to start the countdown when contact is made. Otherwise a user could place his mobile controller 120 on electronic tag 140 to stay in control at least until he picks up mobile controller 120 again.

For example, the time period could be set to about 30 seconds, starting when first wireless channel 152 is broken. This also mimics the behavior of a conventional wall switch but achieves the effect in a different manner. While the user has mobile controller 120 in contact, or close to electronic tag 140, he can control controllable device 110. When he leaves electronic tag 140, say he walks on, he can continue his controlling for a brief interval. Because the interval is short he cannot travel far from electronic tag 140 without releasing control.

The time period may be a predefined period. In this case, electronic tag 140 need only specify that a time period is used; Access control module 130 is configured with the length thereof. The time period may be less than a minute, say 30 seconds, or more than a minute, say, 2 hours or 8 hours.

Instead of a time period, electronic tag 140 may also define an absolute time. For example, control may be released at the end of day, say 19:00. An absolute time for releasing control may be used to start a building management system to take over control of controllable device 110, and possibly many other controllable devices in the building. An absolute time for releasing control may also be used together with office space scheduling software, for example, control may be release at the end of a scheduled meeting.

When the control release condition is more flexible, especially when absolute times are used, the system is better suited to use dual interface tags, which may be programmed from a server, say the building management system, in addition to be being read out over the first wireless channel 152.

Another possibility is for the control release condition to define a geographic area and a time period. These two conditions may be combined in an 'and' fashion or in an 'or' fashion. For example, to implement the 'and' option, access control module 130 may be configured to obtain location information indicating the geographic location of the mobile controller and to terminate the control period if both the geographic location of the mobile controller is outside the geographic area and the control period lasted for at least the time period. For example, to implement the 'or' option, access control module 130 may be configured to obtain location information indicating the geographic location of the mobile controller and to terminate the control period if either the geographic location of the mobile controller is outside the geographic area or the control period lasted for at least the time period, or both. This is also suited for situations in which for some reason the mobile controller cannot obtain or determine its location, e.g. if GPS and/or other location means are turned off, or if its location is not reliable.

For example, time periods may be well be combined with an 'or' option, when the latter corresponds to the building. This would imply that a user releases control as soon as his time is up, or he leaves the building. For example, a user could have control for the duration of a meeting (using either a period or an absolute release time). Control would be released when the meeting ends, or when the user leaves the building. If the user leaves the meeting, say for a coffee break, but returns before the meeting ended, no control is released. Interestingly, the access control module is configured to, after the control period terminated, not to start a new control period until the tag reader wirelessly connects to the electronic tag again.

Access control module 130 may receive the control release condition from the electronic tag through the electronic tag reader. This means that different control release conditions may be set for different controllable devices.

The access control policy is defined in the NFC tag rather than, say, in a central building management system. A smartphone application provided to mobile controller 120 could enforce the access control policy. For example, electronic tag 140 may store the access policy in storage 142 in terms of location and time.

FIG. 1 further shows an optional configuration server 150. Configuration server is configured to store identifying information and/or a control release condition in electronic tag 140. Configuration of tag 140 may use different means than configuration server 150, e.g., during manufacture. Electronic tag 140 and configuration server 150 are configured to communicate with each other over a third channel. The third channel is a wired channel, i.e., at least wired at the interface with tag 140. The third channel may be an I2C channel. When using a configuration server, tag 140 comprises a wired interface for connecting with the configuration server over the third channel. Configuration server 150 may be combined with a BMS and/or with access control module 130.

In an embodiment, a smartphone application for personal light control reads the policy from the NFC tag. The smartphone application ensures that lighting control commands are only sent to the luminaire or to the BMS (building management system) when the user's smartphone is within policy (from location and/or time point of view). For example, when a user's smartphone is too far away from the luminaire the user loses control of the light. In an embodiment, the application is configured to obtain a cryptographic key. For example, the application may comprises the key, e.g., embedded in the application, or the application may obtain the key from a BMS. The application may use the key to decrypt and/or authenticate information obtained from the tag.

Figure 2:
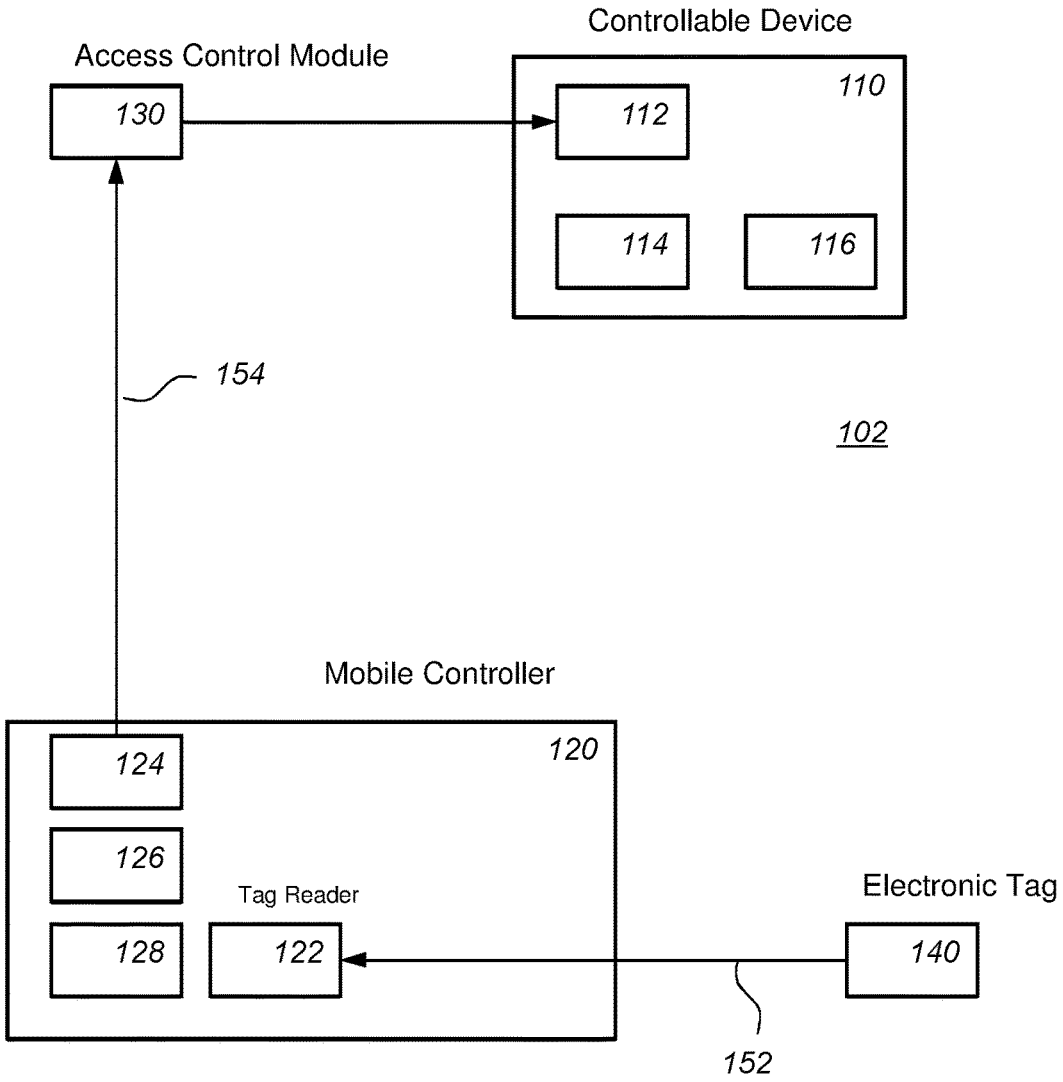
FIG. 2 is a block diagram illustrating a system for remotely controlling a controllable device.

FIG. 2 illustrates a system 102 for remotely controlling controllable device 110. In many respects system 102 may be the same as system 100, however in system 102, access control module 130 is external to the mobile controller 120. Sender 124 is configured to wirelessly send the digital command to access control module 130 over second wireless channel 154. Access control module 130 is configured to verify that the control period of the mobile communication device has started and not terminated and if so sending the digital command to the controllable device.

FIG. 2 shows access control module 130 as a separate device. Access control module 130 may be integrated in a BMS. Access control module 130 may also be integrated in controllable device 110. The latter option avoids a BMS but may increase the price of controllable device 110.

In an embodiment, electronic tag 140*b* is used for electronic tag 140 and access control module 130 is configured to perform a challenge-response protocol with electronic tag 140 via the tag reader 122. For example, access control module 130 may generate a nonce, e.g. a serial number or a random number. Access control module 130 may then send the nonce to the electronic tag as a challenge, by sending the nonce from access control module 130 to mobile controller 120 using second wireless channel 154 and then to electronic tag 140 using first wireless channel 152. Access control module 130 may receive a response from electronic tag depending on the nonce. For example, processor 146 may generate a response by operating on private storage 144 and the nonce. For example, processor 146 may sign or encrypt the nonce using a key stored in private storage 144. Access control module 130 may receive the nonce via first wireless channel 152, tag reader 122, sender 124 and (part of) second wireless channel 154. Access control module 130 is configured to then verify the authenticity of the response in relation to the nonce. Access control module 130 blocks the starting of the control period if said authenticity verification failed, or terminates the control period if it has already started.

If access control module 130 is located in controllable device 110 then the full second wireless channel 154 is used. If access control module 130 is located in mobile controller 120 then second wireless channel 154 is not needed to communicate between access control module 130 and electronic tag 140.

A challenge response protocol provides a high level of trust that mobile controller 120 is actually near electronic tag 140. Although potentially man-in-the-middle attacks are still possible, this is not considered a serious threat since it still requires someone to be physically near electronic tag 140.

Typically, both in systems 100 and 102, the devices 120 and 110 each comprise a microprocessor (not shown) which executes appropriate software stored at devices 120 and 110. For example, the software may have been downloaded and stored in a corresponding memory, e.g. RAM or Flash (neither shown). The devices 140 and 130 may also be equipped with microprocessors and memories (not shown).

In case location based control release conditions are used in system 102 then a locator 126 may be used and comprised in mobile controller 120. Mobile controller 120 may be configured to send location information from mobile controller 120 to access control module 130. However, the locator may also be outside of mobile controller 120. For example, mobile controller 120 may also be located based on its Wi-Fi signal detected at one or more of multiple access points. In the latter case, mobile controller 120 does not need to provide the location information. This increase security since it blocks an attacker from illegally modifying the location information that mobile controller 120 reports.

Figure 4:
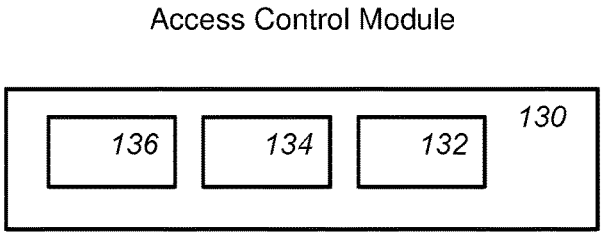
FIG. 4 is a block diagram illustrating an access control module.

FIG. 4 shows a possible implementation of access control module 130. Access control module 130 comprises a storage 132, say a memory, a processor 134 and a sender/receiver (transceiver) 136. Transceiver 136 is configured to communicate over the second channel with mobile controller 120 and controllable device 110. Between controllable device 110 and access control module 130 there may be a BMS. If access control module 130 is comprised in another system, then it may share a processor, memory and communication capabilities with the other system.

During operation, systems 100 and 102 may operate as follows. Mobile controller 120 is brought within communication range of electronic tag 140. Mobile controller 120 and electronic tag 140 establish first wireless channel 152. Mobile controller 120 receives information from electronic tag 140 concerning controllable device 110, e.g., mobile controller 120 reads memory 142 of tag 140. Mobile controller 120 receives at least identifying information for controllable device 110. Mobile controller 120 may also receive the control release condition from electronic tag 140. Access control module 130 is informed that mobile controller 120 and electronic tag 140 established a connection. Access control module 130 then starts a control period. For example, access control module 130 stores, say, an identifier of controllable device 110 received from electronic tag 140, the control release condition. Access control module 130 may also store, say, a time stamp indicating when the connection was established. Mobile controller 120 or access control module 130 may comprise a clock for this purpose. Instead of a time stamp also a timer may be used.

If the system is configured so that time period starts when the connection between mobile controller 120 and tag 140 is broken, then a time stamp for the latter event may be stored instead.

Using user interface controller 128, a user then controls controllable device 110. Based on the user's action a command is generated and send to the access control module 130, optionally together with the current location of mobile controller 120. Access control module 130 then verifies if controllable device 110 may be controlled. For example, depending on the control release condition: access control module 130 verifies that the amount of time that elapsed since contact between electronic tag 140 and mobile controller 120 was established (or broken) is within a time period defined in the control release condition. For example, access control module 130 verifies that the current location of mobile controller 120 is within a geographical area defined by the control release condition. If control release condition is satisfied then the control period is terminated. For example, access control module 130 may delete the information received from electronic tag 140. For example, access control module 130 may mark the information with a flag representing that control was released.

If access control module 130 is outside mobile controller 120 then the required information may be forwarded from mobile controller 120 to access control module 130. The command is send through access control module 130 and access control module 130 may be configured to block forwarding of the command to controllable device 110 is the control period terminated. If access control module 130 is inside mobile controller 120 then the command may be blocked from being sent at all. Access control module 130 may also block generation of the command, say, already in user interface controller 128. If access control module 130 is located in controllable device 110, then access control module 130 may block execution of the command.

If access control module 130 is external to mobile controller 120 and electronic tag 140 is a dual interface, then access control module 130 could be informed of the established and/or breaking of first wireless channel 152 via a channel that does not involve mobile controller 120, e.g., via a wired connection between electronic tag 140 and access control module 130. This improves security.

After the control period ended, access control module 130 requires mobile controller 120 to connect to electronic tag 140 again before starting a new control period.

Figure 5:
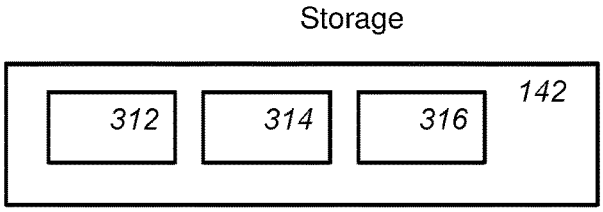
FIG. 5 is a block diagram illustrating a public information storage

FIG. 5 shows a possible implementation of storage 142. Tag 140 stores in the storage accessible by mobile controller 120, the following fields: Authorized software information 312, Controllable device Identifier 314 and Control release information 316.

For example, the optional field authorized software information 312 comprises the location of computer code for access control module 130, and/or user interface controller 128. Controllable device Identifier 314 comprises identifying information of controllable device 110, say, an identifier, or an IP address. Control release information 316 comprises information on the control release condition. Field 316 is optional, since access control module 130 may obtain the control release condition from another source. For example, access control module 130 may obtain the control release condition from a table indexed by controllable device 110's identifier; or for example, all conditions may be equal and hardcoded in access control module 130; or for example, access control module 130 may receive the information from an external source, e.g., a BMS, etc. Nevertheless, receiving the control release condition from electronic tag 140 is a preferred embodiment.

The release condition may be encoded in a variety of ways. For example, a template may be defined in which multiple control release condition can be represented. The control release condition can then be written in tag 140 according to the template. For example, transceiver 136 may contain four fields: (location, range, duration, and/or). Location and range together define a sphere with location as centre and range as the radius. The sphere defines is a geographical area. The duration may be a time period expressing how long it takes for control to be released, 'and/or' indicates whether both conditions must be satisfied before control is released or either condition. Location/range or duration may be set to zero to indicate that the corresponding condition is not used.

FIG. 6*a* shows a building 200. Building 200 has at least one floor 210. Floor 210 has multiple rooms: shown are three rooms: first room 220, second room 230 and third room 240. Third room 240 does not use the system. Although it may have controllable devices, those are under control of a different system, say by a BMS. The first room 220 has a first luminaire 224 and a first tag 222. The second room 230 has a second luminaire 234 and second tag 232. The tags and luminaires are configured according to a system for remotely controlling as described herein. In the example, described here first tag 222 and second tag 232 are configured only with location based controls, wherein the defined areas correspond to the rooms.

A user may walk with his mobile controller 120, say a smartphone to the first room. There mobile controller 120 makes a connection with first tag 222. He then obtains control of first luminaire 224. For example, he turns on the light. When he leaves the room control is released. Mobile controller 120 can no longer control first luminaire 224. It may be that a BMS (not shown), now controls first luminaire 224 and, e.g., turns of the light. When the user then enters second room 230 he may establish a connection with second tag 232. He can then turn on second luminaire 234.

Below additional systems, options and embodiments are described using luminaires, smart phones and NFC tags as examples of controllable devices, mobile controllers and electronic tags, respectively. Other choices are also possible, as indicated herein.

In some cases resources or equipment are located in shared areas where more than one person has access and can issue control commands. Luminaires in an office building are such an example. Some smartphones have the ability to detect location with a relatively good accuracy, e.g., by taking either all or one of the following into account: GPS location coordinates, Wi-Fi access points, Bluetooth beacons, GSM signal and this will become even better in the near future. Near Field Communication (NFC) is a well-known and established (by standards) technology for proximity communication. In the past years most smartphones came equipped with an embedded NFC controller (reader-writer). It is undesirable when users that are not in the close proximity of a resource may issue control commands for it. Such an example is a lighting control smartphone application. When a user enters a given space we would like him to be able to take personal control of the lighting in that area and apply his personal preferences. The inventors realized that by granting control you also need to establish a mechanism to release control, since otherwise you can control an area while away or continuously during the day interfering with the control actions of those that are physically present in that area. For example, when the user leaves the controlled space (or close proximity of it) we would like that he releases control of the lighting solution. This is particularly relevant in shared spaces (such as office buildings).

When a wall switch is used for controlling light, the users controlling the light are constrained to that location, however if the control is moved on a personal mobile device the spatial limitation is lost. Multiple users controlling light within a certain space from a distance could create quite unexpected/confusing situations.

Existing GPS sensor and mapping software in the user's smartphone can be used to determine his location and his relative distance to the luminaire he is controlling. Luminaires in a building have fixed known locations. The user can take and release control of a luminaire by providing an area or a (set of) luminaire with an NFC solution that contains information such as:

identifier of luminaire(s) to control, access policy for that luminaire including location and/or duration, application to use in order to control luminaire, network credentials through which the luminaire can be controlled, A way of limiting access to the application is with duration (e.g. once a user took control of a room he can control the equipment in that room for a limited amount of time), however this approach is limiting in some cases such as office spaces where users spend a considerable amount of time. Another way of limiting control to the luminaires is through a building management system that could oversee who is controlling which light at any moment in time and enforce access policy at that level. This approach introduces latency and can cause a less smooth light transition in case of controlling For example, dim level.

A specific embodiment may include the following elements:

- a smartphone with:
  - one or more location systems such as GPS, 3G network, Wi-Fi, Bluetooth
  - NFC and Wi-Fi connectivity
  - user interface
- a luminaire or set of luminaires (the controllable devices)
- location of the luminaire
- NFC tag(s) each belonging to a luminaire or set of luminaires containing read only information such as:
  - application to be used for lighting control
  - resource identifier (luminaire id)
  - access policy to resource (location boundary and/or timer)

The access control policy may be defined in the NFC tag rather than in a central management system. The smartphone application provided to the users can then enforcing the access control policy. The tag may contain the access policy in terms of location and time. The smartphone application for personal light control reads the policy from the NFC tag. The smartphone application may ensure that lighting control commands are only sent to the luminaire or to the BMS when the user's smartphone is within policy (from location and time point of view). For example, when user's smartphone is too far away from the luminaire the user may lose control of the light. This mechanism ensures that control applications such as a lighting control application can only be used in the close proximity of the physical controlled resource. Numerous light properties of luminaires can be controlled such as: on/off state, dim level, light intensity and color, white level, etc.

Each luminaire of the set of luminaires may be identified with an NFC tag. The NFC tag may define a location boundary in the shape of a sphere represented by its centre and length of the radius. The NFC tag could also define a time boundary. To ensure that the access policy is not changed by unauthorized people, the NFC tag may be read only or only writable by the building management system.

Example NFC Tag Information on a Read-Only NFC Tag:

- Authorized Smartphone app: name
- Luminaire ID: 3452233
- Luminaire location: L(x,y,z)
- Location boundary (defined by sphere): sphere centre C_s (x,y,z) and sphere radius R, or some other defined area, such as an ellipsoid (x,y,z, R1, R2)
- Time boundary: T Additionally the NFC tag could include information on how to access the network through which the lights can be controlled. For e.g. if the lights are controlled through Wi-Fi the NFC tag would contain the Wi-Fi SSID (and password). The lighting control application could automatically join the defined network to allow control of the lights.

This invention can be applied for controlling lights in personal office rooms. An NFC tag may be placed near the light wall switch. All inhabitants of the room gain access to controlling all the lights in that room by touching the tag. Their access expires once the timeout (of for example, 10 hours) expires. After the defined timeout they release control. They can regain control by touching again the NFC tag. A possible extension could include losing control once a location boundary of For example, 100 m is passed (this ensures that for example, a user touches the NFC tag just before leaving, and continues controlling lights from home)

This invention can also be applied for controlling lights in shared office spaces. An NFC tag may be placed on each desk. By touching the NFC tag with his smart phone, the user gains access of the light directly above the desk. The access control policy could be both time and location restricted. This could ensure that users only in the close proximity of the desk (e.g. 10 meters) and for a limited amount of time (For example, 2 hours) can control the lights. Once they release control they must touch the NFC tag again to change light settings.

Another application is for shared meeting rooms. An NFC tag may be placed at the entrance to the room. By touching the NFC tag, the user gains access to all lights in the room. The application could provide the user a number of predefined scenes (e.g. presentation, meeting, brainstorm, etc.). Access to controlling lights could be restricted to the room location. Once the user leaves the vicinity of the room access is lost. Another option is for the BMS to reconfigure the NFC tag each time a meeting starts with the amount of time for which the room was reserved. (For example, if a user made a reservation for a room for 2 hours starting at 10 AM, he gains control of the lights in the room by touching the tag and his access expires at 12 AM). This can be combined with authenticating that the user gaining access is the user who made the reservation (this could ensure that only the meeting organizer can control the lights).

Most office spaces are adjacent, by defining a location boundary in the shape of a sphere we can end up with intersections of two spheres. In this situation a user can control lights in two or multiple locations in the same time (provided that he touched the respective NFC tags). The smartphone application can be designed in such a way that it provides the user with the choice of which lights to control in case the user can control more than one set of lights. An alternative is for the lighting control application to only control just the last set of lights for which the user took control by touching an NFC tag.

The geographic area may also be defined in other ways than spheres, e.g., as polygons, and the like. This is suited to more accurate locators.

Figure 7A:
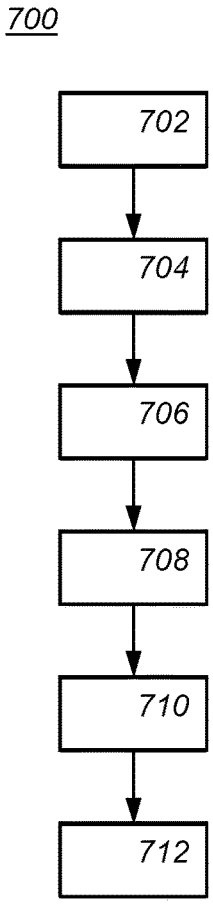
FIGS. 7*a*-7*d* are flowcharts illustrating various methods to control a controllable device remotely.

FIG. 7*a* illustrates as a flow chart a method 700 for remotely controlling a controllable device. Method 700 could be used in systems 100 or 102. Method 700 comprises:

Connecting 702 directly to an electronic tag over a first wireless channel, say by mobile controller 120. Receiving 704 information from the tag identifying the controllable device, say, by mobile controller 120. Sending 706 a digital command wirelessly to the controllable device over a second wireless channel using the information identifying the controllable device, say by mobile controller 120. Allowing 708 control of the controllable device within a control period, say by access control module 130. The control period starts upon the tag reader wirelessly connecting to the electronic tag and terminating when a control release condition is satisfied. Receive 710 a digital command in the controllable device, say by controllable device 110. Modifying 712 an aspect of the controllable device in response to receiving the digital command, say by controllable device 110.

Diagrams 720, 740 and 760 provide several embodiments. These embodiments use lighting control, a smartphone and an NFC tag as examples of controllable device 110, mobile controller 120 and electronic tag 140 respectively. Other choices are also possible, as indicated herein.

Figure 7B:
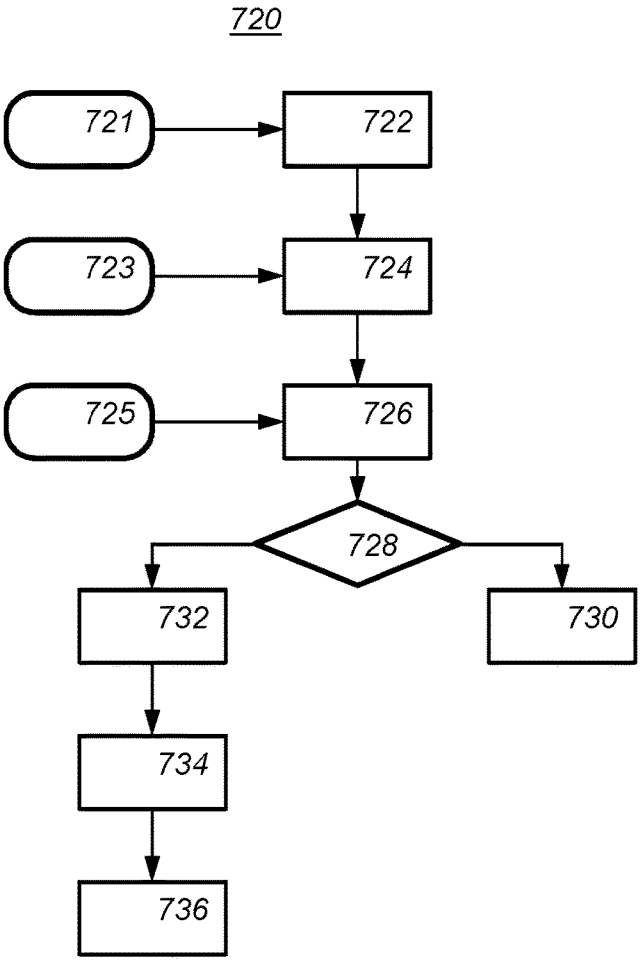

FIG. 7*b* shows a flow diagram illustrating a method based only on location. At 721, a user touches an NFC tag with his smartphone. At 722 the smartphone starts and/or downloads an authorized app and reads the tag. At 723 the user activates the smartphone app. At 724 the smartphone retrieves smartphone coordinates (M(x,y,z)), e.g., via the Locator function. At 726 the smartphone decides if the smartphone coordinate are within a location boundary. Connector 725 indicates periodic repetition of step 724, say every 30 seconds. At 728 this evaluation results in a conditional branch: Is the smartphone within the boundaries, e.g., is distance(C_s, M)<=R' Herein, C_s represents the center of a sphere, say the location of controllable device 110 or of electronic tag 140. R represents the radius of the sphere. If the smartphone is still in the sphere then the branch to 732 is taken, otherwise to 730. At 732 the application controls are enabled. At 734 a user operates the UI to change light settings. At 736 the smartphone sends lights settings to the luminaire. At 730 the application controls are disabled, e.g. grayed out.

Figure 7C:
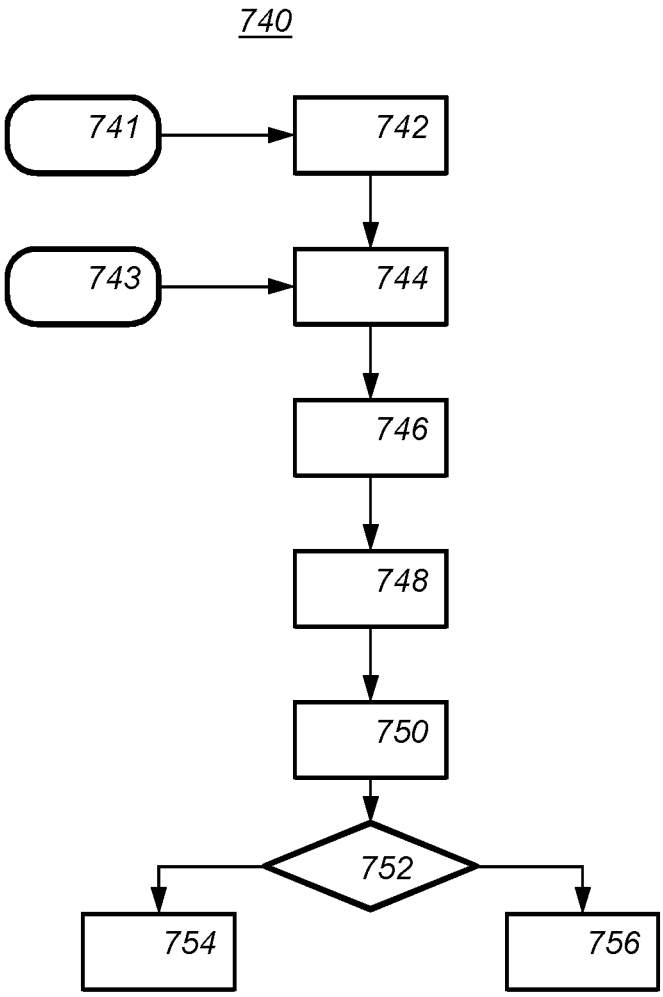

FIG. 7*c*, diagram 740 provides an example of a possible flow diagram based only on location and enforcing the policy at the very last moment just before sending the control command.

At 741, a user touches the NFC tag with his smartphone. At 742 the smartphone starts and/or downloads the authorized app and reads the tag. At 743 the user activates the smartphone app. At 744 the application control are enabled. At 746, the user operates the User Interface to change light settings. At 748 the smartphone app retrieves smartphone coordinates (M(x,y,z)), e.g., via the Locator function. At 750 the smartphone decides if the smartphone coordinates are within a location boundary. At 752 a branch is made conditional upon: Smartphone within boundaries: distance (C_s, M)<=R. If so, the branch goes to 754, otherwise to 756. At 754 the smartphone sends the light settings to the luminaire. At 756 the user interface informs the user that the smartphone is out of range.

Figure 7D:
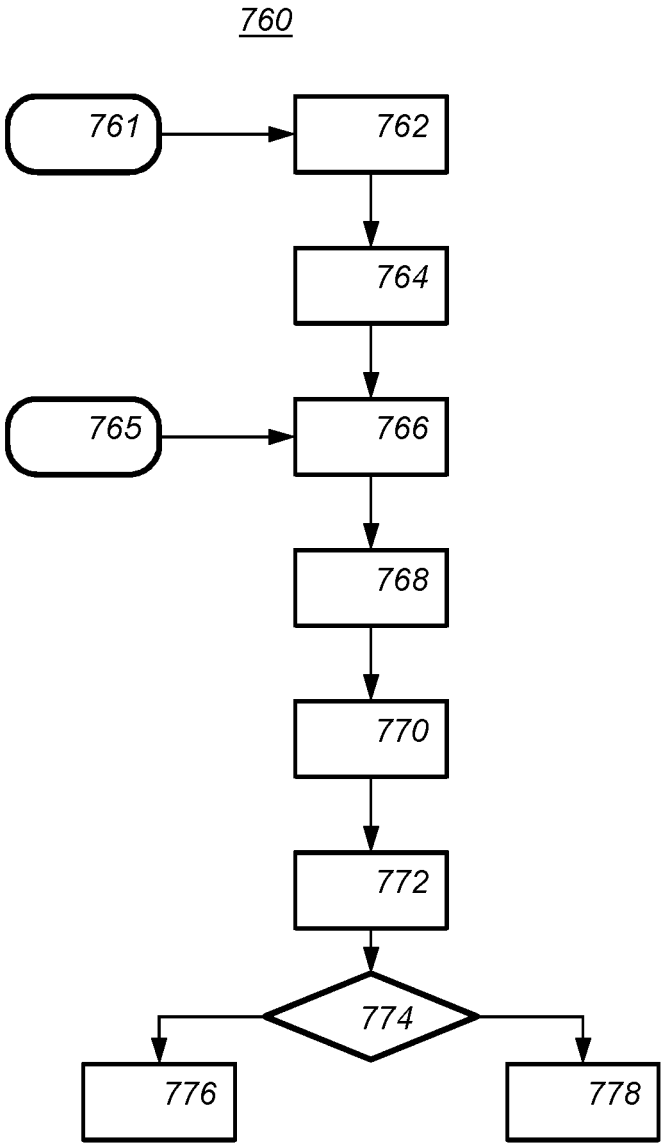

FIG. 7*d*, diagram 760 provides an example of a possible flow diagram based only on timeout. At 761, a user touches the NFC tag with his smartphone. At 762 the smartphone starts and/or downloads the authorized app and reads the tag. The smartphone obtains a time T from the tag. At 764 the smartphone app starts an access time for an amount of time specified by T. At 765 the user activates the smartphone app. At 766 the application controls are enabled. At 768 the user operates the UI to change light settings. At 770 the smartphone sends light settings to luminaire. At 772 the smartphone app retrieves smartphone time and checks if time expired. At 774 a branch is made conditional upon the timer being expired. If so the branch to 776 is taken otherwise to 778. At 776 an out of time indication is given to the user. At 778 the smartphone sends lights settings to luminaire.

Many different ways of executing the methods are possible, as will be apparent to a person skilled in the art. For example, the order of the steps can be varied or some steps may be executed in parallel. Moreover, in between steps other method steps may be inserted. The inserted steps may represent refinements of the method such as described herein, or may be unrelated to the method.

A method according to the invention may be executed using software, which comprises instructions for causing a processor system to perform the methods, e.g., 700, 720, 740, or 760. Software may only include those steps taken by a particular sub-entity of the system. For example, only the steps taken by mobile controller 120, or controllable device 110 or access control module 130, etc, may be included in a particular software product. The software may be stored in a suitable storage medium, such as a hard disk, a floppy, a memory etc. The software may be sent as a signal along a wire, or wireless, or using a data network, e.g., the Internet. The software may be made available for download and/or for remote usage on a server.

It will be appreciated that the invention also extends to computer programs, particularly computer programs on or in a carrier, adapted for putting the invention into practice. The program may be in the form of source code, object code, a code intermediate source and object code such as partially compiled form, or in any other form suitable for use in the implementation of the method according to the invention. An embodiment relating to a computer program product comprises computer executable instructions corresponding to each of the processing steps of at least one of the methods set forth. These instructions may be subdivided into subroutines and/or be stored in one or more files that may be linked statically or dynamically. Another embodiment relating to a computer program product comprises computer executable instructions corresponding to each of the means of at least one of the systems and/or products set forth.

It should be noted that the above-mentioned embodiments illustrate rather than limit the invention, and that those skilled in the art will be able to design many alternative embodiments.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A system for remotely controlling a controllable device, the system comprising:

a mobile controller comprising a tag reader configured to connect to an electronic tag over a first wireless channel and to receive information from the tag identifying the controllable device, wherein the controllable device includes a receiver configured to receive a digital command such that an aspect of the controllable device is modified in response to the digital command; and a sender configured to wirelessly send the digital command to the controllable device over a second wireless channel using the information identifying the controllable device; and an access control module configured to selectively allow the mobile controller to control the controllable device through the digital command, the access control module being configured to allow the mobile controller to control the controllable device within a control period while blocking another mobile controller to control the controllable device during the control period, the control period starting upon the tag reader wirelessly connecting to the electronic tag and terminating when a control release condition is satisfied.

2. The system as in claim 1, wherein the controllable device is one of a luminaire, a heating device, a ventilation device, an air-conditioning device, and a remotely controllable blind, and wherein the aspect of the luminaire is a property of light emitted by the luminaire, the property of light being one of: dim level, light intensity, color, white level and on/off state;

wherein the aspect of the heating device is one of: heating intensity and ambient temperature;

wherein the aspect of the ventilation device is ventilating intensity;

wherein the aspect of the air-conditioning device is one of: air-conditioning intensity and ambient temperature; and wherein the aspect of the remotely controllable blind is an open/close state of the blind.

3. The system as in claim 1, wherein the control release condition defines one of:

a geographic area, the access control module being configured to obtain location information indicating the geographic location of the mobile controller and to terminate the control period if the geographic location of the mobile controller is outside the geographic area;

a time period, the access control module being configured to terminate the control period after the control period lasted for at least the time period;

the geographic area and the time period, the access control module being configured to obtain location information indicating the geographic location of the mobile controller and to terminate the control period if the geographic location of the mobile controller is outside the geographic area and the control period lasted for at least the time period;

the geographic area or the time period, the access control module being configured to obtain location information indicating the geographic location of the mobile controller and to terminate the control period if either the geographic location of the mobile controller is outside the geographic area or the control period lasted for at least the time period.

4. The system as in claim 3, wherein the mobile controller comprises a locator configured to generate the location information indicating the geographic location of the mobile controller.

5. The system as in claim 1, wherein after the control period terminates, the access control module is configured to not start a new control period until the tag reader wirelessly connects to the electronic tag again.

6. The system as in claim 1, wherein the access control module is in the mobile controller, the access control module being configured to receive the control release condition from the electronic tag through the electronic tag reader.

7. The system as in claim 1, wherein the mobile controller is configured to receive from the electronic tag a computer code implementing the access control module.

8. The system as in claim 1, wherein the range of the first communication channel is smaller than 50 centimeters.

9. The system as in claim 1, wherein the access control module is configured to perform a challenge-response protocol with the electronic tag via the tag reader, by generating a nonce, sending the nonce to the electronic tag as a challenge, and receiving a response from electronic tag depending on the nonce, the access control module being configured to verify the authenticity of the response in relation to the nonce, the access control module blocking the starting of the control period if the authenticity verification fails.

10. The system as in claim 1, wherein the access control module is external to the mobile controller, the mobile controller being configured to wirelessly send the digital command to the access control module over the second wireless channel, the access control module being configured to verify that the control period of the mobile controller has started and not terminated and sending the digital command to the controllable device.

11. The system as in claim 1, further comprising a configuration server configured to store at least one of identifying information and a control release condition in the electronic tag, the electronic tag being configured for communicating with the configuration server over a third channel, the electronic tag comprising a wired interface for connecting with the configuration server over the third channel.

12. A method for remotely controlling a controllable device, the method comprising:

connecting to an electronic tag over a first wireless channel;

receiving information from the tag identifying the controllable device;

sending a digital command wirelessly to the controllable device over a second wireless channel using the information identifying the controllable device;

allowing control of the controllable device within a control period while blocking another mobile controller to control the controllable device during the control period, the control period starting upon the tag reader wirelessly connecting to the electronic tag and terminating when a control release condition is satisfied;

receiving the digital command in the controllable device; and modifying an aspect of the controllable device in response to the digital command.

13. A non-transitory computer-readable medium having one or more executable instructions stored thereon, which when executed by a processor, cause the processor to perform a method for remotely controlling a controllable device, the method comprising:

connecting to an electronic tag over a first wireless channel;

receiving information from the tag identifying the controllable device;

sending a digital command wirelessly to the controllable device over a second wireless channel using the information identifying the controllable device;

allowing control of the controllable device within a control period while blocking another mobile controller to control the controllable device during the control period, the control period starting upon the tag reader wirelessly connecting to the electronic tag and terminating when a control release condition is satisfied;

receiving the digital command in the controllable device; and modifying an aspect of the controllable device in response to the digital command.

* * * * *